US008860292B2

(12) United States Patent
Kawai

(10) Patent No.: US 8,860,292 B2
(45) Date of Patent: Oct. 14, 2014

(54) SPARK PLUG AND METHOD OF MANUFACTURING THE SAME

(71) Applicant: NGK Spark Plug Co., Ltd., Nagoya (JP)

(72) Inventor: Tomoki Kawai, Anjo (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/176,499

(22) Filed: Feb. 10, 2014

(65) Prior Publication Data

US 2014/0225496 A1 Aug. 14, 2014

(30) Foreign Application Priority Data

Feb. 13, 2013 (JP) ..... 2013-025146

(51) Int. Cl.
*H01T 13/20* (2006.01)
*H01T 21/02* (2006.01)
*H01T 13/32* (2006.01)

(52) U.S. Cl.
CPC ..... *H01T 21/02* (2013.01); *H01T 13/32* (2013.01)
USPC ..... 313/143; 445/7; 313/144

(58) Field of Classification Search
CPC ..... H01T 21/02; H01T 13/36; H01T 13/34; H01T 13/08; B23K 26/28; B23K 2201/36; B23K 35/3066; B23K 26/063; B23K 35/0261; B23K 35/3033; B23K 35/322; B23K 11/0046; B23K 20/08; B23K 20/10; B23K 2201/006; B23K 2203/08; B23K 2203/18; B23K 26/22; B23K 26/3213; B23K 11/002; B23K 11/0026; B23K 11/004; B23K 11/006; B23K 11/26; B23K 35/0233; B23K 35/0244; B23K 37/0417; B23K 3/08; B23K 9/0026; B21C 23/22; B21C 37/045; B21C 23/183; B21C 23/20; B21C 33/004
USPC ..... 313/118–145
See application file for complete search history.

(56) References Cited

U.S. PATENT DOCUMENTS 8,476,815 B2 7/2013 Kato ..... 313/141

FOREIGN PATENT DOCUMENTS

| | | | |
|---|---|---|---|
| JP | 2003-223968 | 8/2003 | ..... H01T 13/02 |
| JP | 2011-175985 | 9/2011 | ..... H01T 13/20 |
| WO | WO 2009/020141 | 2/2009 | ..... H01T 13/20 |

*Primary Examiner* — Donald Raleigh
(74) *Attorney, Agent, or Firm* — Kusner & Jaffe

(57) ABSTRACT

A spark plug and a method of forming the same. The spark plug having a rod-shaped center electrode extending in an axial direction, a tubular insulator having an axial hole and holding the center electrode in the axial hole, a tubular metallic shell having an end surface, an inner circumferential surface, and a gap formed between the inner circumferential surface and a forward end portion of the insulator, and a ground electrode welded to the end surface. A method of manufacturing the spark plug includes a welding step of welding the ground electrode to the end surface; and a shaping step which is performed after the welding step so as to form the inner circumferential surface, through shaping, on the metallic shell having the ground electrode welded to the end surface thereof.

7 Claims, 11 Drawing Sheets

| Thickness ratio T/S | Thickness of metallic shell T (mm) | Thickness of ground electrode S (mm) | Evaluation |
|---|---|---|---|
| 1.10 | 1.65 | 1.50 | CC |
| 1.15 | 1.375 | 1.20 | CC |
| 1.20 | 1.56 | 1.30 | CC |
| 1.23 | 1.60 | 1.30 | BB |
| 1.31 | 1.70 | 1.30 | BB |
| 1.77 | 2.30 | 1.30 | BB |
| 2.15 | 2.80 | 1.30 | AA |

SPARK PLUG AND METHOD OF MANUFACTURING THE SAME

FIELD OF THE INVENTION

The present invention relates to a spark plug and a method of manufacturing the same.

BACKGROUND OF THE INVENTION

There has been known a spark plug in which a ground electrode is welded to an end surface of a metallic shell, and a gap is formed between the inner circumferential surface of the metallic shell and a forward end portion of an insulator which holds the center electrode (see, for example, Japanese Patent Application Laid-Open (kokai) No. 2003-223968; Japanese Patent Application Laid-Open (kokai) No. 2011-175985; International Patent Publication No. 2009/020141). Japanese Patent Application Laid-Open (kokai) No. 2003-223968; Japanese Patent Application Laid-Open (kokai) No. 2011-175985; and International Patent Publication No. 2009/020141 disclose that after formation of an end surface and an inner circumferential surface on a metallic shell through shaping, a ground electrode is welded to the end surface of the metallic shell. Japanese Patent Application Laid-Open (kokai) No. 2003-223968 further discloses that after the ground electrode has been welded to the metallic shell, an overflow (hereinafter called a "welding sag") resulting from having overflowed onto the surface of the metallic shell is removed.

The techniques of Japanese Patent Application Laid-Open (kokai) No. 2003-223968; Japanese Patent Application Laid-Open (kokai) No. 2011-175985; and International Patent Publication No. 2009/020141 have a problem in that, in the case where the thickness of the metallic shell at an end surface thereof is relatively small as compared with the thickness of the ground electrode, the ground electrode is likely to deviate and drop from the end surface of the metallic shell when the ground electrode is welded to the end surface of the metallic shell. Also, techniques of Japanese Patent Application Laid-Open (kokai) No. 2003-223968; Japanese Patent Application Laid-Open (kokai) No. 2011-175985; and International Patent Publication No. 2009/020141 have a problem in that the inner circumferential surface of the metallic shell may deform due to the influence of heat generated when the ground electrode is welded to the end surface of the metallic shell. These problems become significant when the size of the spark plug is reduced.

The present invention addressed the above-mentioned problems, and can be realized as the following modes.

SUMMARY OF THE INVENTION (1) According to one mode (embodiment) of the present invention, a method of manufacturing a spark plug is provided. This method is adapted to manufacture a spark plug comprising a rod-shaped center electrode extending in an axial direction; a tubular insulator having an axial hole and holding the center electrode in the axial hole; a tubular metallic shell having an end surface and an inner circumferential surface, a gap being formed between the inner circumferential surface and a forward end portion of the insulator; and a ground electrode welded to the end surface. The method comprises a welding step of welding the ground electrode to the end surface; and a shaping step which is performed after the welding step so as to form the inner circumferential surface, through shaping, on the metallic shell having the ground electrode welded to the end surface of the metallic shell.

According to this mode, the metallic shell can have a greater thickness at the end surface in the welding step as compared with the case where the inner circumferential surface has been already formed on the metallic shell through shaping. Therefore, it is possible to prevent the ground electrode from deviating and dropping from the end surface of the metallic shell in the welding step. Also, since the inner circumferential surface is formed through shaping after the welding step, it is possible to avoid deformation of the inner circumferential surface, which deformation would otherwise occur due to the influence of heat generated as a result of welding of the ground electrode. As a result, the production efficiency of the spark plug can be improved.

(2) In the spark plug manufacturing method of the above-described mode, the shaping step may be a step which is performed after the welding step so as to form the inner circumferential surface, through shaping, on the metallic shell having the ground electrode welded to the end surface, while removing a welding sag formed in the welding step. According to this mode, projection of the welding sag from the inner circumferential surface can be avoided. As a result, ignition failure of the spark plug (e.g., lateral spark in which spark discharge toward the inner circumferential surface occurs) can be prevented. Notably, in contrast to this mode, the techniques of the above-mentioned Japanese Patent Application Laid-Open (kokai) No. 2003-223968; Japanese Patent Application Laid-Open (kokai) No. 2011-175985; and International Patent Publication No. 2009/020141 cannot establish a state in which welding sag does not project from the inner circumferential surface of the metallic shell, and therefore have a problem in that an ignition failure occurs due to a decrease in the size of the gap and an increase in field strength caused by the welding sag having overflowed onto the inner circumferential surface.

FIG. 17 is an explanatory view showing, on an enlarged scale, a forward end portion of a conventional spark plug 10*p*. The spark plug 10*p* disclosed in Japanese Patent Application Laid-Open (kokai) No. 2003-223968 has a center electrode 100*p*, an insulator 200*p*, a metallic shell 300*p*, and a ground electrode 400*p*. A gap IG is formed between a forward end portion of the insulator 200*p* and the inner circumferential surface 392*p* of the metallic shell 300*p*. When the spark plug 10*p* is manufactured, a manufacturer welds the ground electrode 400*p* to the end surface 310*p* of the metallic shell 300*p*, and then removes a welding sag 700*p* overflowed onto the surface of the metallic shell 300*p*. When welding sag 700*p* overflowed onto the surface of the metallic shell 300*p* is removed, the extent of removal of the welding sag 700*p* is restricted in order to prevent damage to the inner circumferential surface 392*p*. Therefore, an overflowed portion SD of the welding sag 700*p* remains on the inner circumferential surface 392*p*. The overflowed portion SD of the welding sag 700*p* causes a decrease in the size of the gap IG and an increase in field strength, to thereby cause an ignition failure.

(3) In the spark plug manufacturing method of the above-described mode, the shaping step may be a step which is performed after the welding step so as to form the inner circumferential surface, through shaping, on the metallic shell having the ground electrode welded to the end surface and chamfer an inner periphery of the end surface to thereby form a chamfered portion, while removing a welding sag formed in the welding step. According to this mode, since the chamfered portion increases the size of the gap and decreases the field strength, the ignition performance of the spark plug can be improved.

(4) In the spark plug manufacturing method of the above-described mode, the thickness T of the metallic shell measured in a radial direction at a portion where the inner circumferential surface is formed and the thickness S of the ground electrode measured in the radial direction may satisfy T/S≤1.2. According to this mode, ignition failure caused by welding sag formed in the welding step can be prevented effectively.

(5) According to one mode of the present invention, there is provided a spark plug manufactured by the above-described spark plug manufacturing method. According to this mode, the production efficiency of the spark plug can be improved.

(6) According to one mode of the present invention, a spark plug is provided. This spark plug includes a rod-shaped center electrode extending in an axial direction; a tubular insulator having an axial hole and holding the center electrode in the axial hole; a tubular metallic shell having an end surface and an inner circumferential surface; and a ground electrode welded to the end surface. In the spark plug, a welding sag is formed on the end surface such that the welding sag exists around the ground electrode while avoiding the inner circumferential surface; and the welding sag has a cut surface which is exposed toward a radially inner side of the metallic shell and which is continuous with a surface of the metallic shell. According to this mode, ignition failure caused by welding sag can be prevented.

(7) In the spark plug of the above-described mode, the welding sag may exist around the ground electrode while avoiding the inner circumferential surface and a chamfered portion formed by chamfering an inner periphery of the end surface. According to this mode, since the chamfered portion increases the size of the gap and decreases the field strength, ignition failure caused by welding sag can be prevented more reliably.

The present invention can be realized in various forms other than a spark plug and a method of manufacturing the same. For example, the present invention can be realized in the form of a metallic shell having a ground electrode welded thereto, in the form of an internal combustion engine having a spark plug, or in the form of an apparatus for manufacturing spark plugs.

DETAILED DESCRIPTION OF PREFERRED EMBODIMENTS

Figure 1:
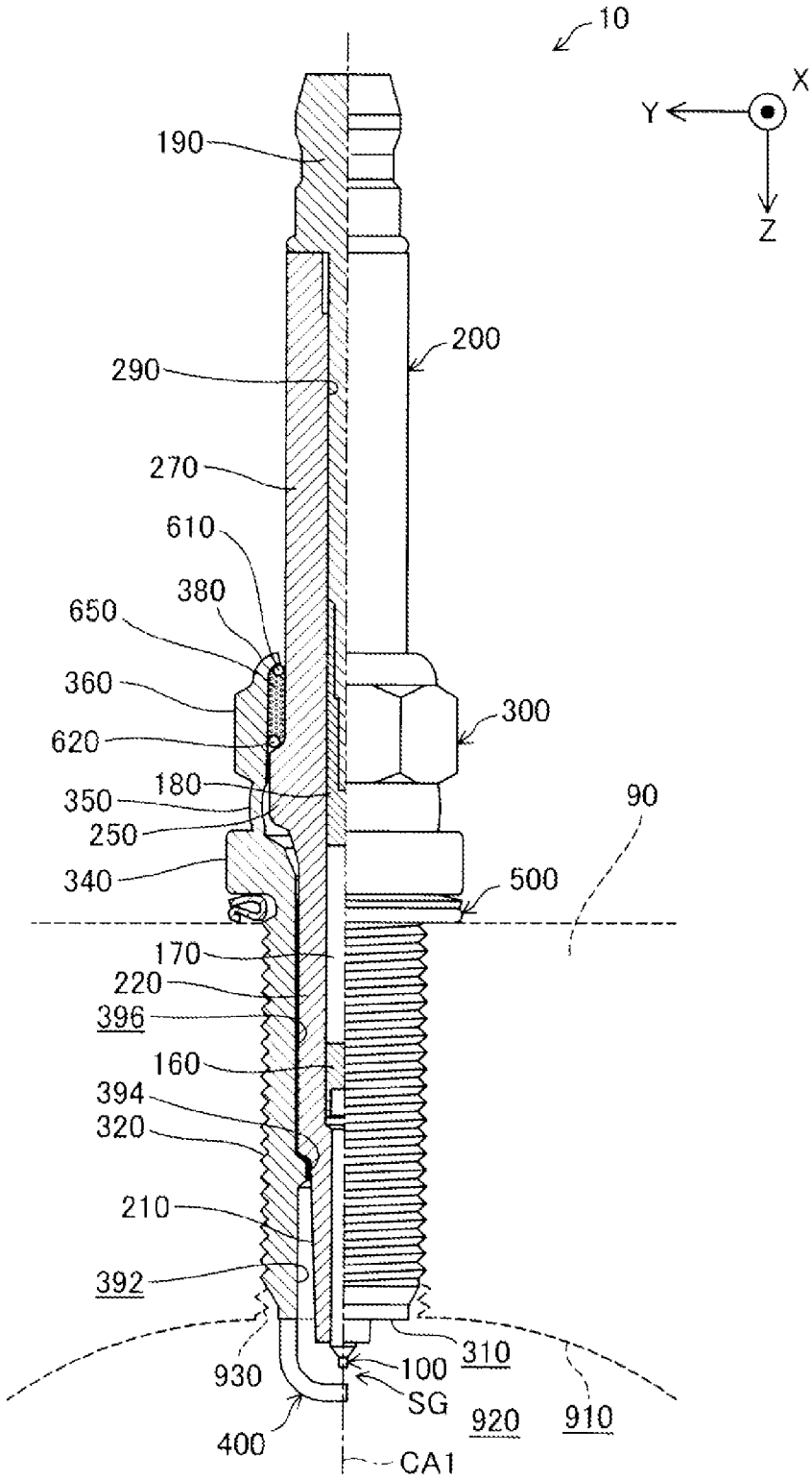
FIG. 1 is an explanatory view showing a partially sectioned spark plug.

A-1. Structure of Spark Plug:

FIG. 1 is an explanatory view showing a partially sectioned spark plug 10. In FIG. 1, an external shape of the spark plug 10 is shown on the right side of an axis CA1, which is the center axis of the spark plug 10, and a cross-sectional shape of the spark plug 10 is shown on the left side of the axis CA1. In the description of the present embodiment, the lower side of the spark plug 10 on the sheet of FIG. 1 will be referred to as the "forward end side," and the upper side of the spark plug 10 on the sheet of FIG. 1 will be referred to as the "rear end side."

The spark plug 10 includes a center electrode 100, an insulator 200, a metallic shell 300, and a ground electrode 400. In the present embodiment, the axis CA1 of the spark plug 10 also serves as the center axes of the center electrode 100, the insulator 200, and the metallic shell 300.

The spark plug 10 has, on the forward end side thereof, a gap SG which is formed between the center electrode 100 and the ground electrode 400. The gap SG of the spark plug 10 is also called "spark gap." The spark plug 10 is configured such that it can be attached to an internal combustion engine 90 in a state in which a forward end portion of the spark plug 10 having the gap SG projects from an inner wall 910 of a combustion chamber 920. When a high voltage of 20,000 V to 30,000 V is applied to the center electrode 100 of the spark plug 10 attached to the internal combustion engine 90, spark discharge is generated at the gap SG. The spark discharge generated at the gap SG realizes ignition of an air-fuel mixture within the combustion chamber 920.

In FIG. 1, X, Y, and Z axes which are orthogonal to one another are shown. The X, Y, and Z axes of FIG. 1 correspond to the X, Y, and Z axes in other drawings which will be described later.

Of the X, Y, and Z axes of FIG. 1, the Z-axis extends along the axis CA1. Of Z axis directions (axial directions) along the Z axis, a +Z axis direction is a direction directed from the rear end side toward the forward end side of the spark plug 10, and a −Z axis direction is a direction opposite the +Z axis direction. The +Z axis direction is the direction in which the center electrode 100 extends along the axis CA1 and projects from the forward end of the metallic shell 300 together with the insulator 200.

Of the X, Y, and Z axes of FIG. 1, the Y axis extends along a direction in which the ground electrode 400 is bent toward the axis CA1. Of Y axis directions along the Y axis, a −Y axis direction is a direction in which the ground electrode 400 is bent toward the axis CA1, and a +Y axis direction is a direction opposite the −Y axis direction.

Of the X, Y, and Z axes of FIG. 1, the X axis extends perpendicular to the Y axis and the Z axis. Of X axis directions along the X axis, a +X axis direction is a direction directed from the back side of the sheet of FIG. 1 toward the front side thereof, and an −X axis direction is a direction opposite the +X axis direction.

The center electrode 100 of the spark plug 10 is a member having electrical conductivity. The center electrode 100 has the shape of a rod extending along the axis CA1. In the present embodiment, the center electrode 100 is formed of a nickel alloy (e.g., Inconel (registered trademark)), which contains nickel (Ni) as a main component. The outer surface of the center electrode 100 is electrically insulated from the outside by the insulator 200. A forward end portion of the center electrode 100 projects from a forward end portion of the insulator 200. A rear end portion of the center electrode 100 is electrically connected to a metallic terminal 190 at the rear end side of the insulator 200. In the present embodiment, the rear end portion of the center electrode 100 is electrically connected to the metallic terminal 190 at the rear end side of the insulator 200 through a seal 160, a ceramic resistor 170, and a seal 180.

The ground electrode 400 of the spark plug 10 is a member having electrical conductivity. The ground electrode 400 extends from the metallic shell 300 in parallel with the axis CA1, and then bends toward the axis CA1. A base end portion of the ground electrode 400 is welded to the metallic shell 300. A distal end portion of the ground electrode 400 forms the gap SG in cooperation with the center electrode 100. In the present embodiment, the ground electrode 400 is formed of a nickel alloy (e.g., Inconel (registered trademark)), which contains nickel (Ni) as a main component.

The insulator 200 of the spark plug 10 is a ceramic insulator which is electrically insulative. The insulator 200 has the shape of a tube extending along the axis CA1. In the present embodiment, the insulator 200 is formed by firing an insulating ceramic material (e.g., alumina).

The insulator 200 has an axial hole 290, which is a through-hole extending along the axis CA1. The center electrode 100 is held in the axial hole 290 of the insulator 200 to be located on the axis CA1 and project from the forward end of the insulator 200 (in the +Z axis direction). A first tubular portion 210, a second tubular portion 220, a third tubular portion 250, and a fourth tubular portion 270 are formed on the outer side of the insulator 200 in this order from the forward end toward the rear end thereof.

The first tubular portion 210 of the insulator 200 is a cylindrical portion whose diameter decreases toward the forward end thereof, and a forward end portion of the first tubular portion 210 projects from the forward end of the metallic shell 300. The second tubular portion 220 of the insulator 200 is a cylindrical portion which has a diameter greater than that of the first tubular portion 210. The third tubular portion 250 of the insulator 200 is a cylindrical portion which projects radially outward relative to the second tubular portion 220 and the fourth tubular portion 270. The fourth tubular portion 270 of the insulator 200 is a cylindrical portion which extends rearward from the third tubular portion 250, and a rear end portion of the fourth tubular portion 270 projects from the rear end of the metallic shell 300.

The metallic shell 300 of the spark plug 10 is a metallic member having electrical conductivity. The metallic shell 300 has the shape of a tube which extends coaxially with the axis CA1. In the present embodiment, the metallic shell 300 is a nickel-plated tubular member formed of low-carbon steel. In other embodiments, the metallic shell 300 may be a zinc-plated member, or an unplated member.

The metallic shell 300 is fixed, by means of crimping, to the outer surface of the insulator 200 in a state in which the metallic shell 300 is electrically insulated from the center electrode 100. An end surface 310, a screw portion 320, a trunk portion 340, a groove portion 350, a tool engagement portion 360, and a crimp cover 380 are formed on the outer side of the metallic shell 300 in this order from the forward end toward the rear end thereof.

The end surface 310 of the metallic shell 300 defines the forward end (on the +Z axis direction side) of the metallic shell 300. In the present embodiment, the end surface 310 is a flat surface which extends along the X axis and the Y axis and which faces toward the +Z axis direction. In the present embodiment, the end surface 310 is an annular flat surface. The ground electrode 400 is welded to the end surface 310. The insulator 200 projects, together with the center electrode 100, toward the +Z axis direction through the central opening of the end surface 310.

In other embodiments, the end surface 310 may be a surface inclined toward the inner side of the metallic shell 300, or a surface inclined toward the outer side of the metallic shell 300. In other embodiments, the end surface 310 may be a curved surface or may be composed of a plurality of surfaces which form a step(s).

The screw portion 320 of the metallic shell 300 is a cylindrical portion which has a screw thread formed on the outer surface thereof. In the present embodiment, the spark plug 10 can be mounted to the internal combustion engine 90 by screwing the screw portion 320 of the metallic shell 300 into a threaded hole 930 of the internal combustion engine 90. In the present embodiment, the nominal diameter of the screw portion 320 is M10. In other embodiments, the nominal diameter of the screw portion 320 may be smaller than M10 (e.g., M8) or larger than M10 (e.g., M12, M14).

The trunk portion 340 of the metallic shell 300 is a flange-shaped portion which projects radially outward relative to the groove portion 350. In a state in which the spark plug 10 is mounted to the internal combustion engine 90, a gasket 500 is compressed between the trunk portion 340 and the internal combustion engine 90.

The groove portion 350 of the metallic shell 300 is a cylindrical portion which bulges radially outward when the metallic shell 300 is fixed to the insulator 200 by means of crimping. The groove portion 350 is located between the trunk portion 340 and the tool engagement portion 360.

The tool engagement portion 360 of the metallic shell 300 is a flange-shaped portion which projects radially outward relative to the groove portion 350, and has a polygonal cross section. The tool engagement portion 360 has a shape suitable for engagement with a tool (not shown) used to mount the spark plug 10 to the internal combustion engine 90. In the present embodiment, the tool engagement portion 360 has a hexagonal outer shape.

The crimp cover 380 of the metallic shell 300 is a portion formed by bending a rear end portion of the metallic shell 300 toward the insulator 200. The crimp cover 380 is formed when the metallic shell 300 is fixed to the insulator 200 by means of crimping.

Ring members 610 and 620 are disposed between the third and fourth tubular portions 250 and 270 of the insulator 200 and the tool engagement portion 360 and crimp cover 380 of the metallic shell 300 such that the ring member 610 is located on the rear end side, and the ring member 620 is located on the forward end side. Powder 650 is charged between the ring members 610 and 620.

The insulator 200 is held inside the metallic shell 300 such that the insulator 200 projects from the forward end (on the +Z axis direction side) of the metallic shell 300 together with the center electrode 100. An inner circumferential surface 392, an annular convex portion 394, and an inner circumferential surface 396 are formed on the inner side of the metallic shell 300 in this order from the forward end toward the rear end thereof.

The inner circumferential surface 392 of the metallic shell 300 is located forward of the annular convex portion 394. The annular convex portion 394 of the metallic shell 300 projects inward relative to the inner circumferential surface 392 and the inner circumferential surface 396. The inner circumferential surface 396 of the metallic shell 300 is located rearward of the annular convex portion 394.

Figure 2:
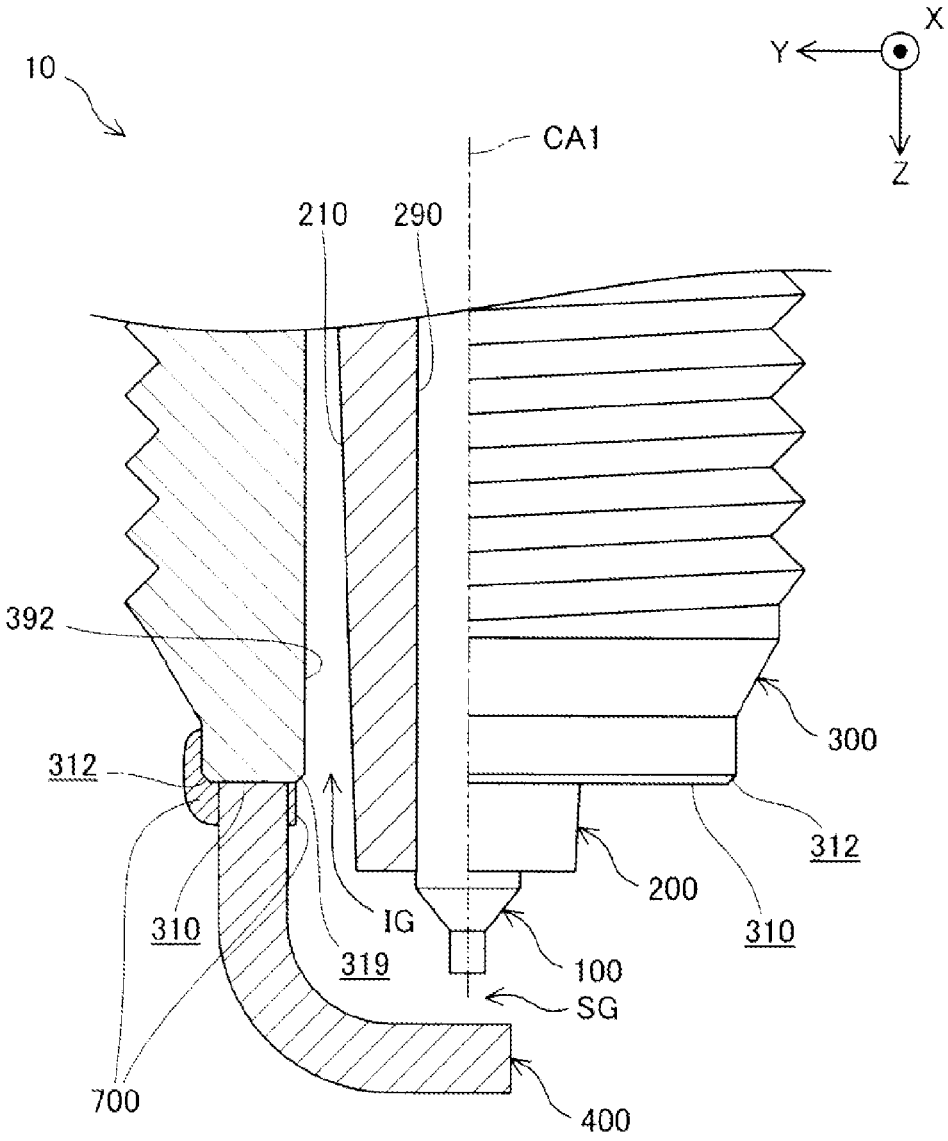
FIG. 2 is an explanatory view showing, on an enlarged scale, a forward end portion of the spark plug.
Figure 3:
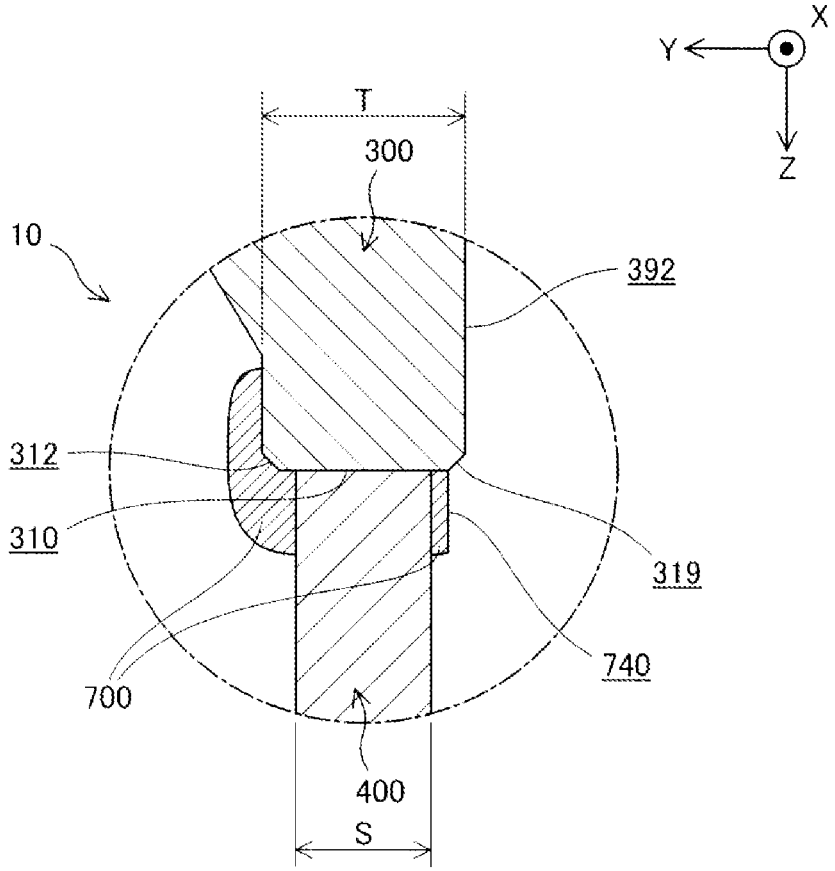
FIG. 3 is an explanatory view showing, on a further enlarged scale, a cross section of a portion where a ground electrode has been welded to a metallic shell.

FIG. 2 is an explanatory view showing, on an enlarged scale, a forward end portion of the spark plug 10. FIG. 3 is an explanatory view showing, on a further enlarged scale, a cross section of a portion where the ground electrode 400 is welded to the metallic shell 300.

In the present embodiment, a chamfered portion 312 is formed along the outer periphery of the end surface 310. In the present embodiment, the chamfered portion 312 has a flat surface. In another embodiment, the chamfered portion 312 may have a rounded surface. In another embodiment, the chamfered portion 312 may be omitted.

In the present embodiment, a chamfered portion 319 is formed along the inner periphery of the end surface 310. In the present embodiment, the chamfered portion 319 has a flat surface. In another embodiment, the chamfered portion 319 may have a rounded surface. In another embodiment, the chamfered portion 319 may be omitted.

A gap IG is formed between the inner circumferential surface 392 of the metallic shell 300 and the first tubular portion 210 of the insulator 200. The gap IG prevents occurrence of lateral spark toward the inner circumferential surface 392.

A welding sag 700 which is formed when the ground electrode 400 is welded to the end surface 310 remains on the end surface 310 such that it surrounds the ground electrode 400. After the ground electrode 400 is welded to the end surface 310, the inner circumferential surface 392 of the metallic shell 300 is formed through shaping, while a portion of the welding sag 700 formed on the radially inner side (on the −Y axis direction side) of the metallic shell 300 is removed. Therefore, the welding sag 700 exists in surface regions excluding the inner circumferential surface 392. In the present embodiment, the chamfered portion 319 is also formed together with the inner circumferential surface 392 after the round electrode 400 is welded to the end surface 310. Therefore, the welding sag 700 exists in surface regions excluding the inner circumferential surface 392 and the chamfered portion 319.

The welding sag 700 has a cut surface 740 which is exposed toward the radially inner side (the −Y axis direction side) of the metallic shell 300. The cut surface 740 is formed when the inner circumferential surface 392 is formed through shaping after the ground electrode 400 has been welded to the end surface 310. In the present embodiment, the cut surface 740 is a surface extending along the Z axis. The cut surface 740 is continuous with the surface of the metallic shell 300; in the present embodiment, continuous with the chamfered portion 319. In another embodiment in which the chamfered portion 319 is not provided, the cut surface 740 may be continuous with the inner circumferential surface 392.

The thickness T (in the radial direction (the Y axis direction)) of the metallic shell 300 at a portion thereof where the inner circumferential surface 392 is formed is greater than the thickness S of the ground electrode 400 in the Y axis direction. The thickness T of the metallic shell 300 includes the thickness of the chamfered portion 312 in the Y axis direction and the thickness of the chamfered portion 319 in the Y axis direction. From the viewpoint of preventing occurrence of ignition failure caused by the welding sag 700, formation of the inner circumferential surface 392 after welding of the ground electrode 400 to the end surface 310 is effective when the thickness ratio T/S is equal to or smaller than 1.77, and more effective when the thickness ratio T/S is equal to or smaller than 1.20. The evaluation of the thickness ratio T/S will be described later.

Figure 4:
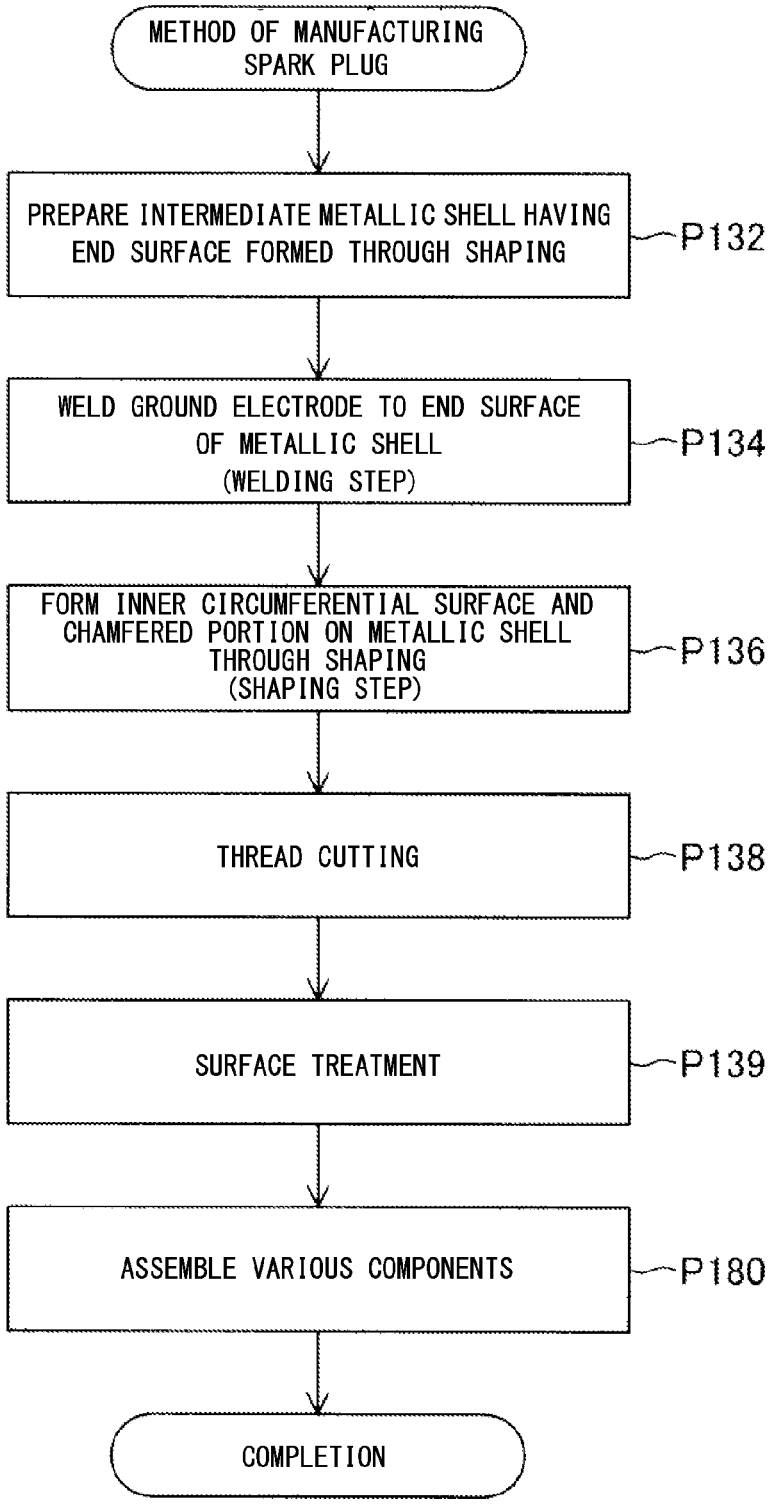
FIG. 4 is a flowchart showing a method of manufacturing the spark plug.
Figures 5, 6:
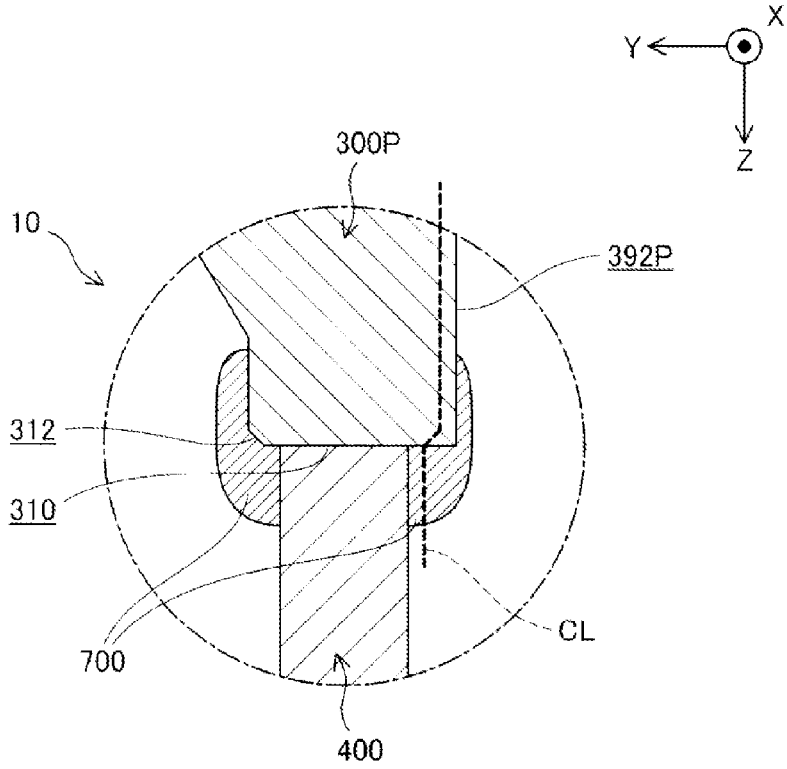
FIG. 5 is an explanatory view showing the state of manufacture of the spark plug.
FIG. 6 is a table showing the results of a test performed to evaluate the relation between thickness ratio and welding sag in comparative samples.

A-2. Method of Manufacturing Spark Plug:

FIG. 4 is a flowchart showing a method of manufacturing the spark plug 10. FIG. 5 is an explanatory view showing the state of manufacture of the spark plug 10.

When the spark plug 10 is to be manufactured, a manufacturer prepares a metallic shell 300P which is an intermediate of the metallic shell 300 (step P132). In the present embodiment, in step P132, the manufacturer makes the metallic shell 300P through press work and cutting work.

As shown in FIG. 5, the metallic shell 300P has a tubular shape on which at least the end surface 310 has been formed. In the present embodiment, the metallic shell 300P does not have the screw portion 320. In the present embodiment, the metallic shell 300P has the chamfered portion 312. The metallic shell 300P does not have the inner circumferential surface 392 and the chamfered portion 319, but has an inner circumferential surface 392P whose diameter is smaller than that of the inner circumferential surface 392. The difference in diameter between the inner circumferential surface 392 and the inner circumferential surface 392P is equal to a cutting allowance by which the inner circumferential wall of the metallic shell 300P is cut in a later step so as to form the inner circumferential surface 392. Preferably, the diameter difference (cutting allowance) is equal to or greater than 0.1 mm in order to secure the machining accuracy of the inner circumferential surface 392.

Referring back to FIG. 4, after preparation of the metallic shell 300P (step P132), the manufacturer performs a welding step (step P134) of welding the ground electrode 400 to the end surface 310 of the metallic shell 300P. In the present embodiment, in the welding step (step P134), the manufacturer fixes the metallic shell 300P such that the end surface 310 faces upward. In this state, while pressing the ground electrode 400 against the end surface 310, the manufacturer joins the end surface 310 and the ground electrode 400 together by means of resistance welding. In the present embodiment, the ground electrode 400 used in the welding step (step P134) is not bent and extends straight.

As shown in FIG. 5, the welding sag 700 is formed on the end surface 310 to surround the ground electrode 400 in the welding step (step P134). In the welding step (step P134), the welding sag 700 is formed such that it extends from the end surface 310 onto the inner circumferential surface 392P.

Referring back to FIG. 4, after completion of the welding step (step P134), the manufacturer performs a shaping step (step P136) of forming the inner circumferential surface 392 on the metallic shell 300P through shaping. In the present embodiment, in the shaping step (step P136), the manufacturer forms the inner circumferential surface 392 on the metallic shell 300P through shaping, and simultaneously forms the chamfered portion 319 on the metallic shell 300P through shaping.

As shown in FIG. 5, in the present embodiment, in the shaping step (step P136), the manufacturer forms the chamfered portion 319 and the inner circumferential surface 392 through shaping, while removing the welding sag 700 along a dashed line CL. In the present embodiment, in the shaping step (step P136), the manufacturer forms the chamfered portion 319 and the inner circumferential surface 392 by means of turning. In other embodiments, in the shaping step (step P136), the manufacturer may form the chamfered portion 319 and the inner circumferential surface 392 by performing, in addition to or in place of turning, at least one of other types of cutting (e.g., milling and drilling), grinding, and polishing.

As a result of performance of the shaping step (step P136), as shown in FIG. 3, the cut surface 740 is formed on the welding sag 700, and the chamfered portion 319 and the inner circumferential surface 392 are formed on the metallic shell 300P.

Referring back to FIG. 4, after completion of the shaping step (step P136), the manufacturer forms the screw portion 320 on the metallic shell 300P through thread cutting (step P138). After that, the manufacturer performs surface treatment (zinc plating) on the metallic shell 300P (step P139). As a result, the metallic shell 300 is completed.

After completion of the metallic shell 300 (step P139), the manufacturer assembles other members (the center electrode 100, the insulator 200, etc.) into the metallic shell 300 (step P180). As a result, the spark plug 10 is completed. In the present embodiment, the manufacturer bends the ground electrode 400 when the other members are assembled into the metallic shell 300.

A-3. Evaluation of Spark Plug:

FIG. 6 is a table showing the results of a test performed to evaluate the relation between the thickness ratio T/S and the welding sag 700 in comparative samples. In the evaluation test whose results are shown in FIG. 6, a tester prepared, as comparative samples, a plurality of spark plugs which differed in the thickness ratio T/S. Unlike the spark plug 10 of the above-described embodiment, these samples had metallic shells on which the chamfered portion 319 and the inner circumferential surface 392 were formed through shaping before welding of the ground electrode 400. The tester evaluated the welding sag 700 of each sample on the basis of the following evaluation criteria.

AA: the welding sag 700 is not present on the inner circumferential surface 392, and the possibility of occurrence of lateral spark is zero.

BB: the welding sag 700 is present on the inner circumferential surface 392; however, the possibility of occurrence of lateral spark is low.

CC: the welding sag 700 is present on the inner circumferential surface 392, and the possibility of occurrence of lateral spark is high.

The results of the evaluation test shown in FIG. 6 reveal the following. From the viewpoint of preventing occurrence of ignition failure caused by the welding sag 700, formation of the inner circumferential surface 392 after welding of the ground electrode 400 to the end surface 310 as in the case of the spark plug 10 of the above-described embodiment is effective when the thickness ratio T/S is equal to or smaller than 1.77, and more effective when the thickness ratio T/S is equal to or smaller than 1.20.

A-4. Effects:

According to the above-described embodiment, the metallic shell 300 can have a greater thickness at the end surface 310 in the welding step (step P134) as compared with the case where the inner circumferential surface 392 has been already formed on the metallic shell 300 through shaping. Therefore, it is possible to prevent the ground electrode 400 from deviating and dropping from the end surface 310 of the metallic shell 300 in the welding step (step P134). Also, since the inner circumferential surface 392 is formed through shaping after the welding step (step P134), it is possible to avoid deformation of the inner circumferential surface 392, which deformation would otherwise occur due to the influence of heat generated as a result of welding of the ground electrode 400. As a result, the production efficiency of the spark plug 10 can be improved.

Also, in the above-described embodiment, projection of the welding sag 700 from the inner circumferential surface 392 can be avoided. As a result, ignition failure of the spark plug 10 (e.g., lateral spark in which spark discharge toward the inner circumferential surface 392 occurs) can be prevented.

Also, since the chamfered portion 319 increases the size of the gap IG and decreases the field strength, the ignition performance of the spark plug 10 can be improved.

Figure 7:
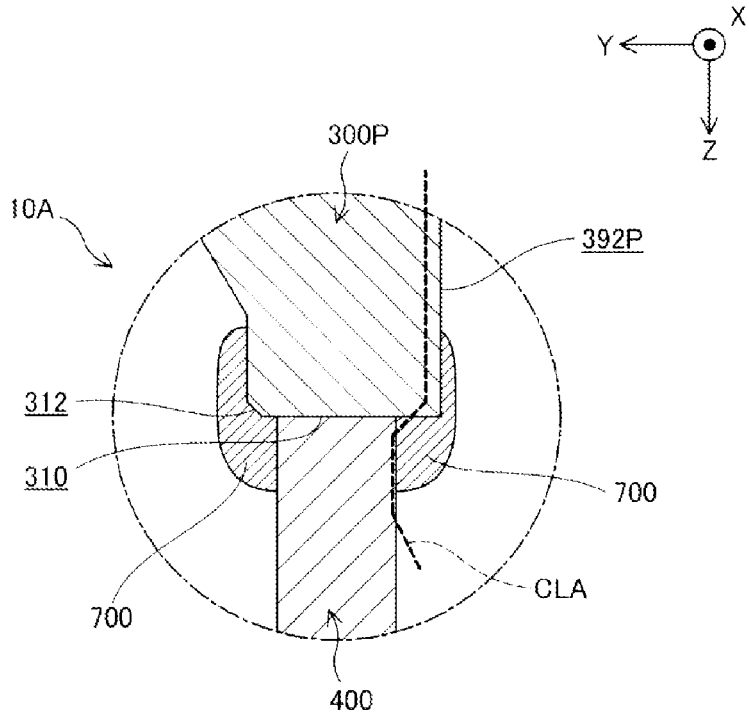
FIG. 7 is an explanatory view showing the state of manufacture of a spark plug of a first modification.
Figure 8:
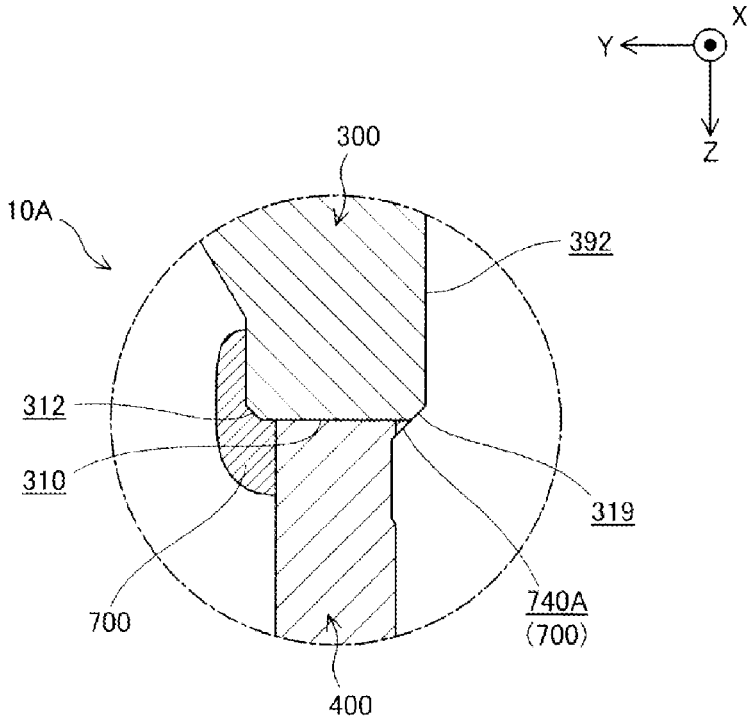
FIG. 8 is an explanatory view showing, on an enlarged scale, a cross section of a portion where a ground electrode has been welded to a metallic shell in the spark plug of the first modification.

A-5. Modifications:

A-5-1. First Modification:

FIG. 7 is an explanatory view showing the state of manufacture of a spark plug 10A of a first modification. FIG. 8 is an explanatory view showing, on an enlarged scale, a cross section of a portion where the ground electrode 400 is welded to the metallic shell 300 in the spark plug 10A of the first modification. The spark plug 10A of the first modification is identical to the spark plug 10 of the above-described embodiment except that, as shown in FIG. 7, the shaping step (step P136) is performed along a dashed line CLA.

As shown in FIG. 8, the welding sag 700 of the first modification has a cut surface 740A which is exposed toward the radially inner side (the −Y axis direction side) of the metallic shell 300. The cut surface 740A is formed when the circumferential surface 392 is formed through shaping after the ground electrode 400 has been welded to the end surface 310. The cut surface 740A is continuous with the chamfered portion 319 and is inclined in relation to the inner circumferential surface 392 at the same angle as the chamfered portion 319. The cut surface 740A is continuous with the surface of the ground electrode 400.

According to the first modification, as in the case of the above-described embodiment, the production efficiency of the spark plug 10A can be improved. Also, ignition failure of the spark plug 10A can be prevented.

Figure 9:
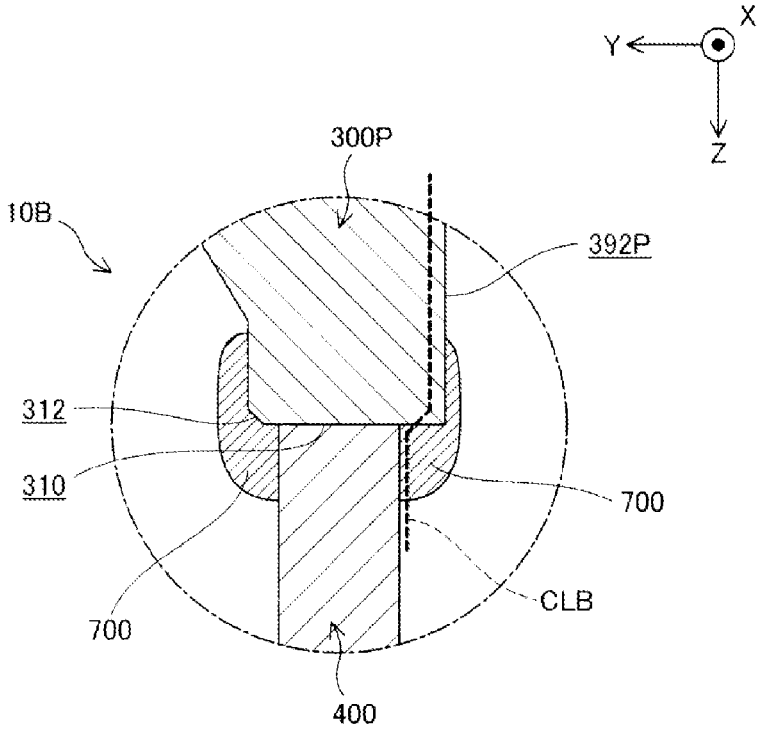
FIG. 9 is an explanatory view showing the state of manufacture of a spark plug of a second modification.
Figure 10:
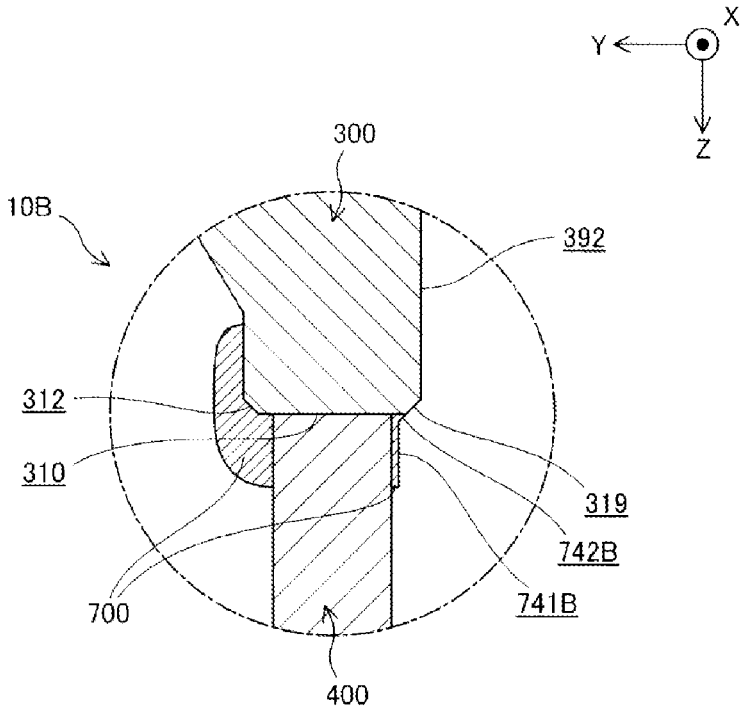
FIG. 10 is an explanatory view showing, on an enlarged scale, a cross section of a portion where a ground electrode has been welded to a metallic shell in the spark plug of the second modification.

A-5-2. Second Modification:

FIG. 9 is an explanatory view showing the state of manufacture of a spark plug 10B of a second modification. FIG. 10 is an explanatory view showing, on an enlarged scale, a cross section of a portion where the ground electrode 400 is welded to the metallic shell 300 in the spark plug 10B of the second modification. The spark plug 10B of the second modification is identical to the spark plug 10 of the above-described embodiment except that, as shown in FIG. 9, the shaping step (step P136) is performed along a dashed line CLB.

As shown in FIG. 10, the welding sag 700 of the second modification has cut surfaces 741B and 742B which are exposed toward the radially inner side (the −Y axis direction side) of the metallic shell 300. The cut surfaces 741B and 742B are formed when the circumferential surface 392 is formed through shaping after the ground electrode 400 has been welded to the end surface 310. The cut surface 741B extends along the Z axis to the cut surface 742B. The cut surface 742B is continuous with the chamfered portion 319 and is inclined in relation to the inner circumferential surface 392 at the same angle as the chamfered portion 319.

According to the second modification, as in the case of the above-described embodiment, the production efficiency of the spark plug 10B can be improved. Also, ignition failure of the spark plug 10B can be prevented.

Figure 11:
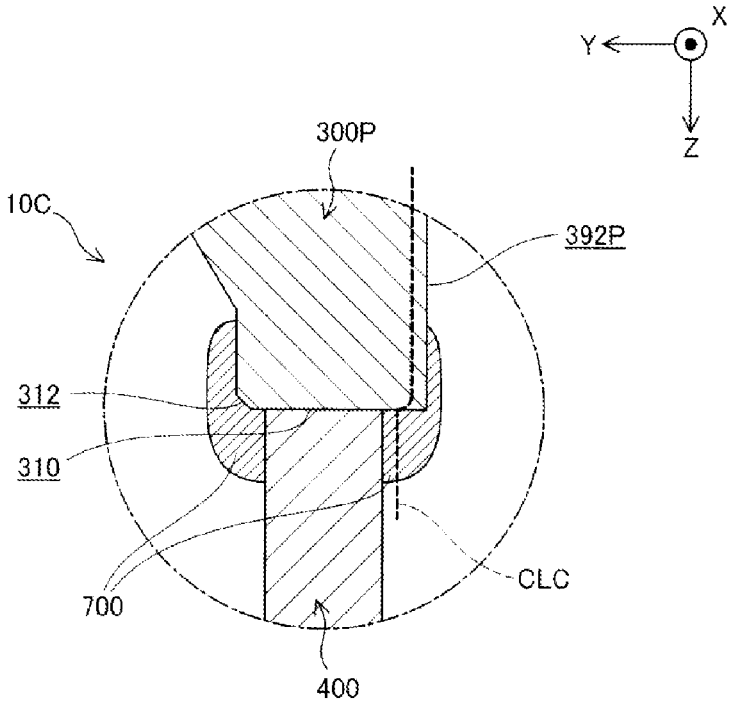
FIG. 11 is an explanatory view showing the state of manufacture of a spark plug of a third modification.
Figure 12:
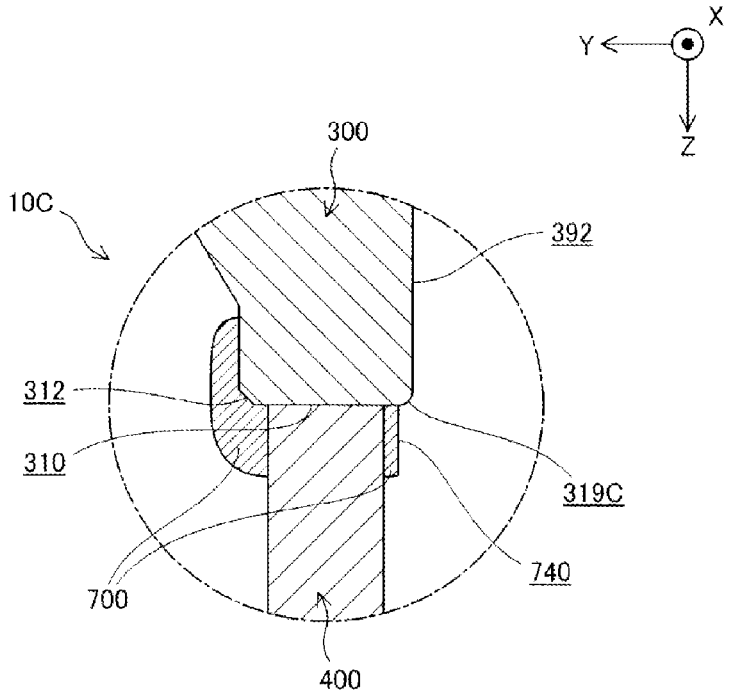
FIG. 12 is an explanatory view showing, on an enlarged scale, a cross section of a portion where a ground electrode has been welded to a metallic shell in the spark plug of the third modification.

A-5-3. Third Modification:

FIG. 11 is an explanatory view showing the state of manufacture of a spark plug 10C of a third modification. FIG. 12 is an explanatory view showing, on an enlarged scale, a cross section of a portion where the ground electrode 400 is welded to the metallic shell 300 in the spark plug 10C of the third modification. The spark plug 10C of the third modification is identical to the spark plug 10 of the above-described embodiment except that, as shown in FIG. 11, the shaping step (step P136) is performed along a dashed line CLC.

As shown in FIG. 12, in the third modification, a chamfered portion 319C having a rounded surface is formed along the inner periphery of the end surface 310. The cut surface 740 of the welding sag 700 is continuous with the chamfered portion 319C.

According to the third modification, as in the case of the above-described embodiment, the production efficiency of the spark plug 10C can be improved. Also, ignition failure of the spark plug 10C can be prevented.

Figure 13:
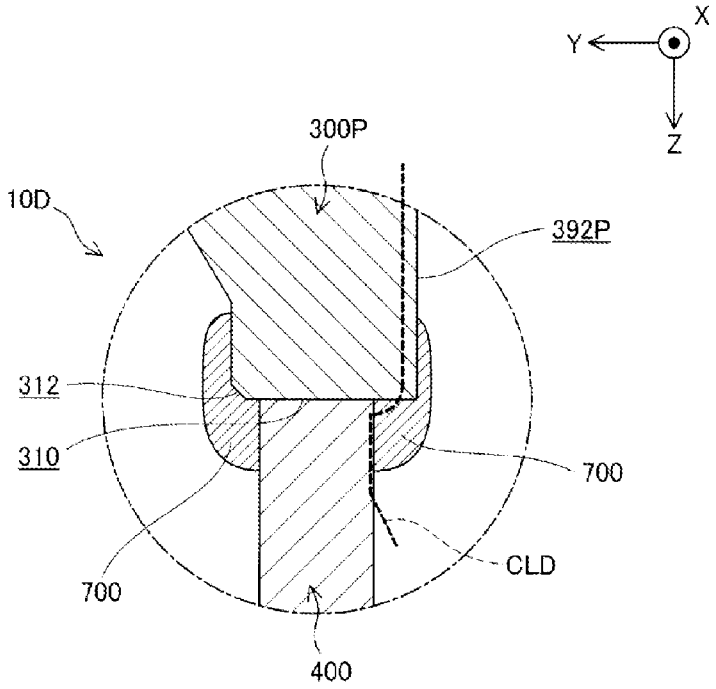
FIG. 13 is an explanatory view showing the state of manufacture of a spark plug of a fourth modification.
Figure 14:
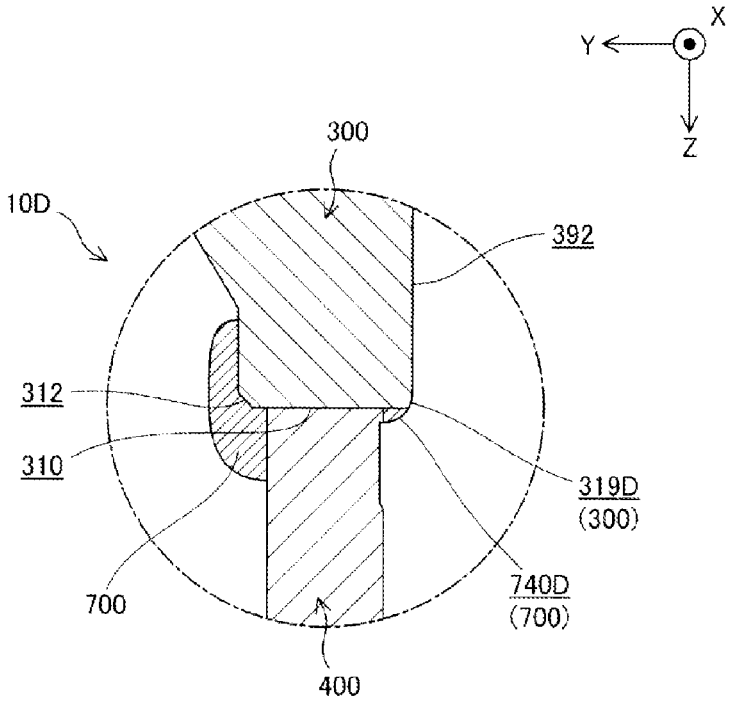
FIG. 14 is an explanatory view showing, on an enlarged scale, a cross section of a portion where a ground electrode has been welded to a metallic shell in the spark plug of the fourth modification.

A-5-4. Fourth Modification:

FIG. 13 is an explanatory view showing the state of manufacture of a spark plug 10D of a fourth modification. FIG. 14 is an explanatory view showing, on an enlarged scale, a cross section of a portion where the ground electrode 400 is welded to the metallic shell 300 in the spark plug 10D of the fourth modification. The spark plug 10D of the fourth modification is identical to the spark plug 10 of the above-described embodiment except that, as shown in FIG. 13, the shaping step (step P136) is performed along a dashed line CLD.

As shown in FIG. 14, in the fourth modification, a chamfered portion 319D having a rounded surface is formed along the inner periphery of the end surface 310. The welding sag 700 of the fourth modification has a cut surface 740D which is exposed toward the radially inner side (the −Y axis direction side) of the metallic shell 300. The cut surfaces 740D is formed when the circumferential surface 392 is formed through shaping after the ground electrode 400 has been welded to the end surface 310. The cut surface 740D is continuous with the chamfered portion 319D and forms a rounded surface together with the chamfered portion 319D. The cut surface 740D is continuous with the surface of the ground electrode 400.

According to the fourth modification, as in the case of the above-described embodiment, the production efficiency of the spark plug 10D can be improved. Also, ignition failure of the spark plug 10D can be prevented.

Figure 15:
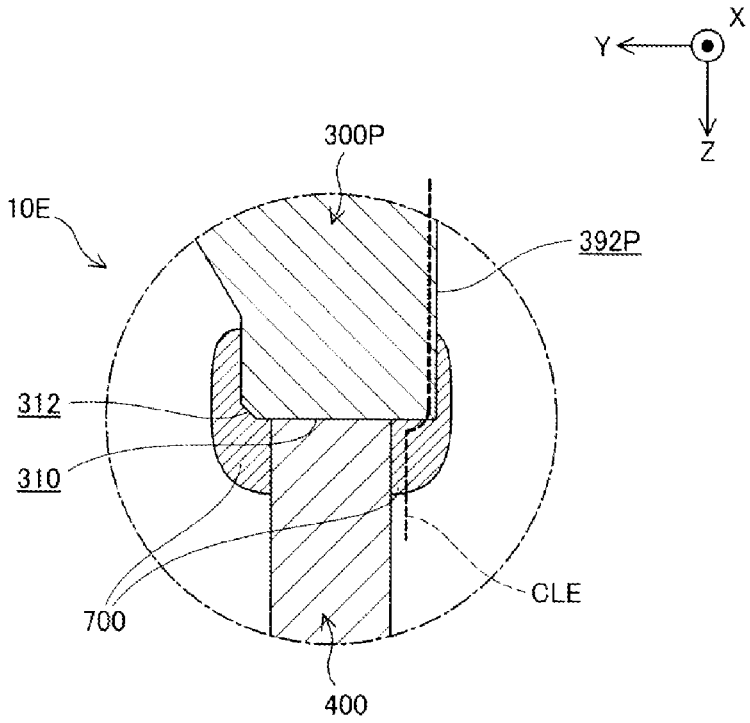
FIG. 15 is an explanatory view showing the state of manufacture of a spark plug of a fifth modification.
Figure 16:
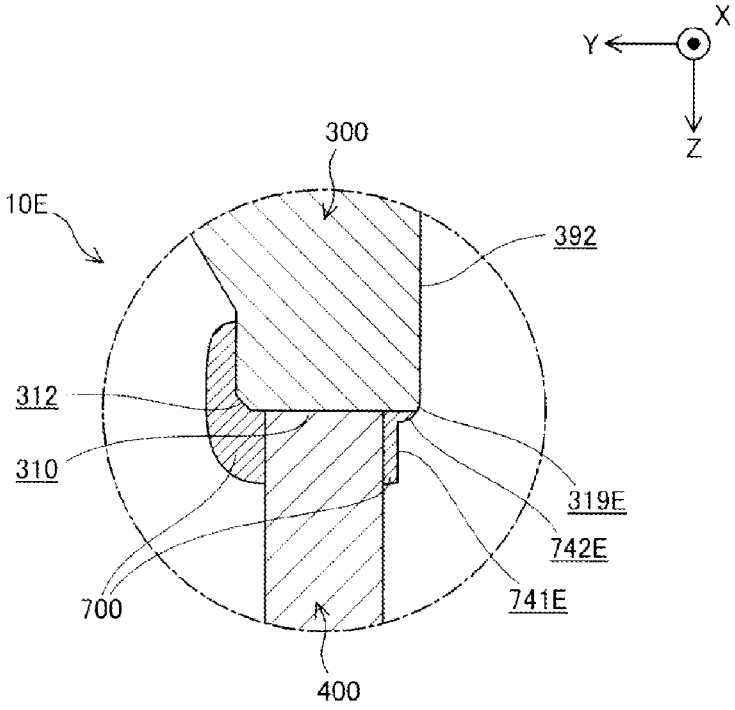
FIG. 16 is an explanatory view showing, on an enlarged scale, a cross section of a portion where a ground electrode has been welded to a metallic shell in the spark plug of the fifth modification.
Figure 17:
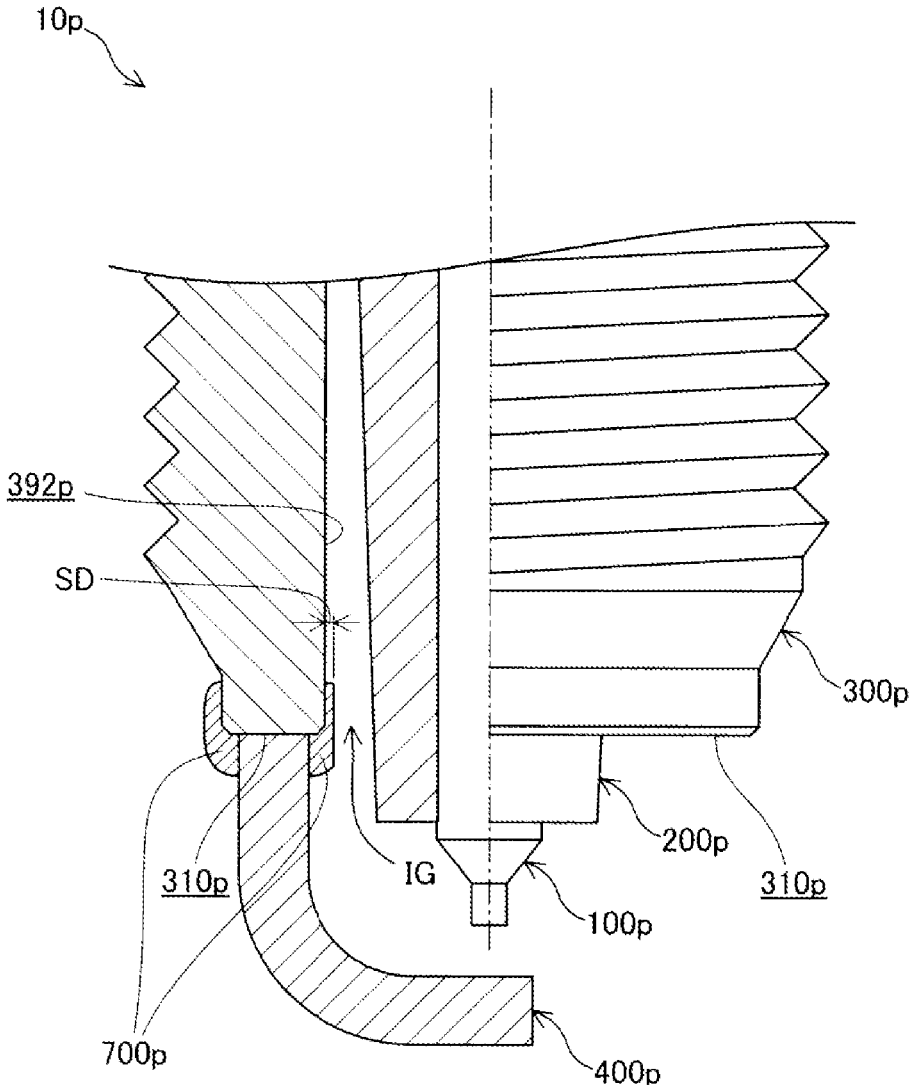
FIG. 17 is an explanatory view showing, on an enlarged scale, a forward end portion of a conventional spark plug.

A-5-5. Fifth Modification:

FIG. 15 is an explanatory view showing the state of manufacture of a spark plug 10E of a fifth modification. FIG. 16 is an explanatory view showing, on an enlarged scale, a cross section of a portion where the ground electrode 400 is welded to the metallic shell 300 in the spark plug 10E of the fifth modification. The spark plug 10E of the fifth modification is identical to the spark plug 10 of the above-described embodiment except that, as shown in FIG. 15, the shaping step (step P136) is performed along a dashed line CLE.

As shown in FIG. 16, in the fifth modification, a chamfered portion 319E having a rounded surface is formed along the inner periphery of the end surface 310. The welding sag 700 of the fifth modification has cut surfaces 741E and 742E which are exposed toward the radially inner side (the −Y axis direction side) of the metallic shell 300. The cut surfaces 741E and 742E are formed when the circumferential surface 392 is formed through shaping after the ground electrode 400 has been welded to the end surface 310. The cut surface 741E extends along the Z axis to the cut surface 742E. The cut surface 742E is continuous with the chamfered portion 319E and forms a rounded surface together with the chamfered portion 319E.

According to the fifth modification, as in the case of the above-described embodiment, the production efficiency of the spark plug 10E can be improved. Also, ignition failure of the spark plug 10E can be prevented.

B. Other Embodiments:

The present invention is not limited to the above-described embodiment, examples, and modifications, and can be realized in various forms without departing from the scope of the invention. For example, the technical features in the embodiment, examples, and modifications which correspond to the technical features in the respective modes described in the "Summary of the Invention" section may be freely replaced or combined in order to solve a portion or the entity of the above-described problems or to attain a portion or the entity of the above-described effects. Also, a technical feature(s) may be omitted if it is not described as an essential feature in the present specification.

For example, at least a portion of the inner circumferential surface and chamfered portion of the metallic shell may be formed by welding sag.

DESCRIPTION OF REFERENCE NUMERALS

10, 10A, 10B, 10C, 10D, 10E: spark plug
90: internal combustion engine
100: center electrode
160: seal
170: ceramic resistor
180: seal
190: metallic terminal
200: insulator
210: first tubular portion
220: second tubular portion
250: third tubular portion
270: fourth tubular portion
290: axial hole
300, 300P: metallic shell
310: end surface
312: chamfered portion
319, 319C, 319D, 319E: chamfered portion
320: screw portion
340: trunk portion
350: groove portion
360: tool engagement portion
380: crimp cover
392: inner circumferential surface
392P: inner circumferential surface
394: annular convex portion
396: inner circumferential surface
400: ground electrode
500: gasket
610: ring member

620: ring member
650: powder
700: welding sag
740: cut surface
740A: cut surface
740D: cut surface
741B: cut surface
741E: cut surface
742B: cut surface
742E: cut surface
910: inner wall
920: combustion chamber
930: threaded hole
SG: gap
IG: gap Having described the invention, the following is claimed:

1. A method of manufacturing a spark plug having a rod-shaped center electrode extending in an axial direction;

a tubular insulator having an axial hole and holding the center electrode in the axial hole;

a tubular metallic shell having an end surface and an inner circumferential surface, a gap being formed between the inner circumferential surface and a forward end portion of the insulator; and a ground electrode welded to the end surface, the method comprising the steps of:

a welding step of welding the ground electrode to the end surface; and a shaping step which is performed after the welding step, said shaping step forming the inner circumferential surface on the metallic shell having the ground electrode welded to the end surface of the metallic shell.

2. A method of manufacturing a spark plug according to claim 1, wherein the shaping step comprises removing a welding sag formed in the welding step.

3. A method of manufacturing a spark plug according to claim 1 or 2, wherein the shaping step is a step which is performed after the welding step so as to form the inner circumferential surface, through shaping, on the metallic shell having the ground electrode welded to the end surface and chamfer an inner periphery of the end surface to thereby form a chamfered portion, while removing a welding sag formed in the welding step.

4. A method of manufacturing a spark plug according to claim 1 or 2, wherein a thickness T of the metallic shell measured in a radial direction at a portion where the inner circumferential surface is formed and a thickness S of the ground electrode measured in the radial direction satisfy $T/S \leq 1.2$.

5. A spark plug manufactured by a method of manufacturing a spark plug according to claim 1 or 2.

6. A spark plug comprising:

a rod-shaped center electrode extending in an axial direction;

a tubular insulator having an axial hole and holding the center electrode in the axial hole;

a tubular metallic shell having an end surface and an inner circumferential surface; and a ground electrode welded to the end surface, a welding sag formed on the end surface such that the welding sag exists around the ground electrode while avoiding the inner circumferential surface; and the welding sag having a cut surface which is exposed toward a radially inner side of the metallic shell and which is continuous with a surface of the metallic shell.

7. A spark plug according to claim 6, wherein the welding sag exists around the ground electrode while avoiding the inner circumferential surface and a chamfered portion formed by chamfering an inner periphery of the end surface.

* * * * *